US008262412B1

(12) United States Patent
Minnick et al.

(10) Patent No.: US 8,262,412 B1
(45) Date of Patent: Sep. 11, 2012

(54) ELECTRICAL CONNECTOR HAVING COMPENSATION FOR AIR POCKETS

(75) Inventors: Timothy R. Minnick, Enola, PA (US); David W. Helster, Dauphin, PA (US); Alex M. Sharf, Harrisburg, PA (US); Chad W. Morgan, Woolwich Township, NJ (US)

(73) Assignee: Tyco Electronics Corporation, Berwyn, PA (US)

( * ) Notice: Subject to any disclaimer, the term of this patent is extended or adjusted under 35 U.S.C. 154(b) by 0 days.

(21) Appl. No.: 13/104,446

(22) Filed: May 10, 2011

(51) Int. Cl.
*H01R 13/648* (2006.01)

(52) U.S. Cl. ..... 439/607.01

(58) Field of Classification Search ..... 439/607.01, 439/607.08, 607.03, 607.11, 941
See application file for complete search history.

(56) References Cited

U.S. PATENT DOCUMENTS

| | | | | |
|---|---|---|---|---|
| 5,795,191 | A * | 8/1998 | Preputnick et al. | 439/607.11 |
| 6,461,202 | B2 * | 10/2002 | Kline | 439/701 |
| 6,471,549 | B1 * | 10/2002 | Lappohn | 439/607.05 |
| 6,551,140 | B2 * | 4/2003 | Billman et al. | 439/607.07 |
| 6,592,381 | B2 | 7/2003 | Cohen et al. | |
| 6,808,420 | B2 * | 10/2004 | Whiteman et al. | 439/607.08 |
| 6,969,280 | B2 * | 11/2005 | Chien et al. | 439/607.13 |
| 7,172,461 | B2 * | 2/2007 | Davis et al. | 439/607.11 |
| 7,326,082 | B2 | 2/2008 | Sharf | |
| 7,384,311 | B2 | 6/2008 | Sharf et al. | |
| 7,727,017 | B2 * | 6/2010 | Amleshi et al. | 439/607.11 |
| 7,867,031 | B2 * | 1/2011 | Amleshi et al. | 439/607.08 |

FOREIGN PATENT DOCUMENTS

| | | | |
|---|---|---|---|
| EP | 2048794 | A2 | 4/2009 |
| WO | 2008/156851 | A2 | 12/2008 |

OTHER PUBLICATIONS

International Search Report, International Application No. PCT/US2012/036046, International Filing Date May 2, 2012.

* cited by examiner

*Primary Examiner* — Jean F Duverne

(57) ABSTRACT

An electrical connector includes a contact module that has a lead frame and a dielectric frame that encases the lead frame. The dielectric frame includes opposite sides and a mating edge and a mounting edge. The dielectric frame has voids that extend from the sides to expose the lead frame. The lead frame has a plurality of contacts that have transition portions that extend between mating portions that extend from the mating edge and mounting portions that extend from the mounting edge. The transition portions have compensation segments and intermediate segments between the compensation segments. The intermediate segments are encased in the dielectric frame. The compensation segments are exposed by the voids. The compensation segments have a geometry that differs from a geometry of the intermediate segments.

20 Claims, 6 Drawing Sheets

ELECTRICAL CONNECTOR HAVING COMPENSATION FOR AIR POCKETS

BACKGROUND OF THE INVENTION

The subject matter described herein relates generally to electrical connectors.

Some known electrical connectors use a plurality of contact modules that are held together in a housing. The contact modules each include a plurality of contacts formed from lead frames that are overmolded in dielectric bodies during an overmolding process. During the overmolding process, pinch pins are utilized to retain the lead frame while the plastic is molded over the lead frame. The pinch pins are secured along various locations of the contacts to hold the lead frame in place during overmolding. After the overmolding process the pinch pins are released to release the lead frame.

However, conventional contact modules are not without their disadvantages. During the overmolding process, the pinch pins leave voids or air pockets along the contacts. The air pockets may affect an overall performance of the electrical connector. In particular, the air pockets have different dielectric properties in comparison to the overmolding material. The air pockets may increase an impedance of the contact. For example, the contact may be designed to have a target impedance of 50 Ohms. However, the air pockets may increase the impedance of the contact to over 50 Ohms. As such, the contacts may experience reduced speeds and signal strength. Additionally, an electromagnetic field between the contact and a shield may also be altered by the air pockets.

A need remains for an electrical connector that compensates for air pockets formed in contact modules during an overmolding process.

SUMMARY OF THE INVENTION

In one embodiment, an electrical connector is provided having a contact module that has a lead frame and a dielectric frame that encases the lead frame. The dielectric frame includes opposite sides and a mating edge and a mounting edge. The dielectric frame has voids that extend from the sides to expose the lead frame. The lead frame has a plurality of contacts that have transition portions that extend between mating portions that extend from the mating edge and mounting portions that extend from the mounting edge. The transition portions have compensation segments and intermediate segments between the compensation segments. The intermediate segments are encased in the dielectric frame. The compensation segments are exposed by the voids. The compensation segments have a geometry that differs from a geometry of the intermediate segments.

In another embodiment, an electrical connector is provided having a contact module having a holder that holds a pair of dielectric frames. Each dielectric frame encases a corresponding lead frame. The holder defines a shield body providing electrical shielding around the dielectric frames. Each dielectric frame includes opposite sides, a mating edge and a mounting edge. Each dielectric frame has voids extending from the sides to expose the corresponding lead frame. Each lead frame includes a plurality of contacts having transition portions extending between mating portions extending from the mating edge and mounting portions extending from the mounting edge. The transition portions have compensation segments and intermediate segments between the compensation segments. The intermediate segments are encased in the corresponding dielectric frame while the compensation segments are exposed by the voids in the corresponding dielectric frame. The compensation segments have a geometry that differs from a geometry of the intermediate segments.

In a further embodiment, an electrical connector is provided having a contact module that includes a lead frame and a dielectric frame encasing the lead frame. The contact module further includes a shield body extending along the dielectric frame. The dielectric frame includes opposite sides, a mating edge and a mounting edge, the dielectric frame having voids extending from the sides to expose the lead frame. The lead frame includes a plurality of contacts having transition portions extending between mating portions extending from the mating edge and mounting portions extending from the mounting edge. The transition portions have compensation segments and intermediate segments between the compensation segments. The intermediate segments are encased in the dielectric frame while the compensation segments are exposed by the voids. The shield body extends along at least one of the sides of the dielectric frame and covers corresponding voids in the side of the dielectric frame. The shield body is positioned in closer proximity to the compensation segments than to the intermediate segments.

DETAILED DESCRIPTION OF THE INVENTION

The foregoing summary, as well as the following detailed description of certain embodiments will be better understood when read in conjunction with the appended drawings. As used herein, an element or step recited in the singular and proceeded with the word "a" or "an" should be understood as not excluding plural of said elements or steps, unless such exclusion is explicitly stated. Furthermore, references to "one embodiment" are not intended to be interpreted as excluding the existence of additional embodiments that also incorporate the recited features. Moreover, unless explicitly stated to the contrary, embodiments "comprising" or "having" an element or a plurality of elements having a particular property may include additional such elements not having that property.

Figure 1:
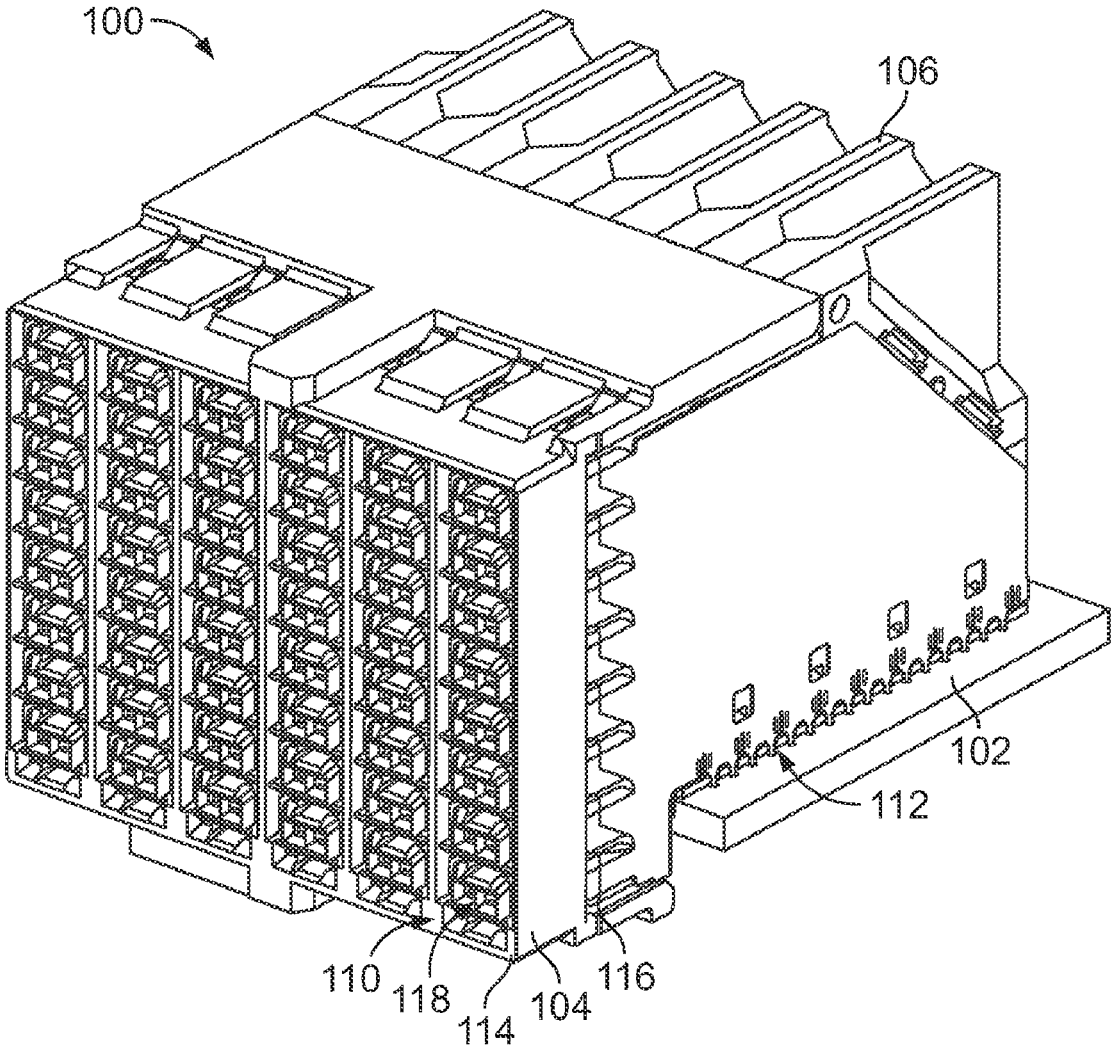
FIG. 1 is a front perspective view of an exemplary electrical connector formed in accordance with an exemplary embodiment.

FIG. 1 is a front perspective view of an exemplary electrical connector 100 formed in accordance with an exemplary embodiment. The electrical connector 100 is mounted to a circuit board 102. The electrical connector 100 represents a receptacle connector that is configured to be mated with a header connector (not shown) mounted to another circuit board (not shown).

The electrical connector 100 includes a front housing 104 and a plurality of contact modules 106 received within the front housing 104. The contact modules 106 hold a plurality of contacts 108 (shown in FIG. 2) that are configured to be mated to the header connector and terminated to the circuit board 102. The electrical connector 100 has a mating interface 110 that is configured to be mated with the header connector. The electrical connector 100 has a mounting interface 112 that is terminated to the circuit board 102. Optionally, the mating and mounting interfaces 110, 112 may be perpendicular to one another.

The front housing 104 includes a front 114 and a rear 116. The front housing 104 has a plurality of contact channels 118 extending therethrough between the front 114 and the rear 116. The contact modules 106 are loaded into the front housing 104 through the rear 116. The front 114 defines the mating interface 110 of the electrical connector 100.

Figure 2:
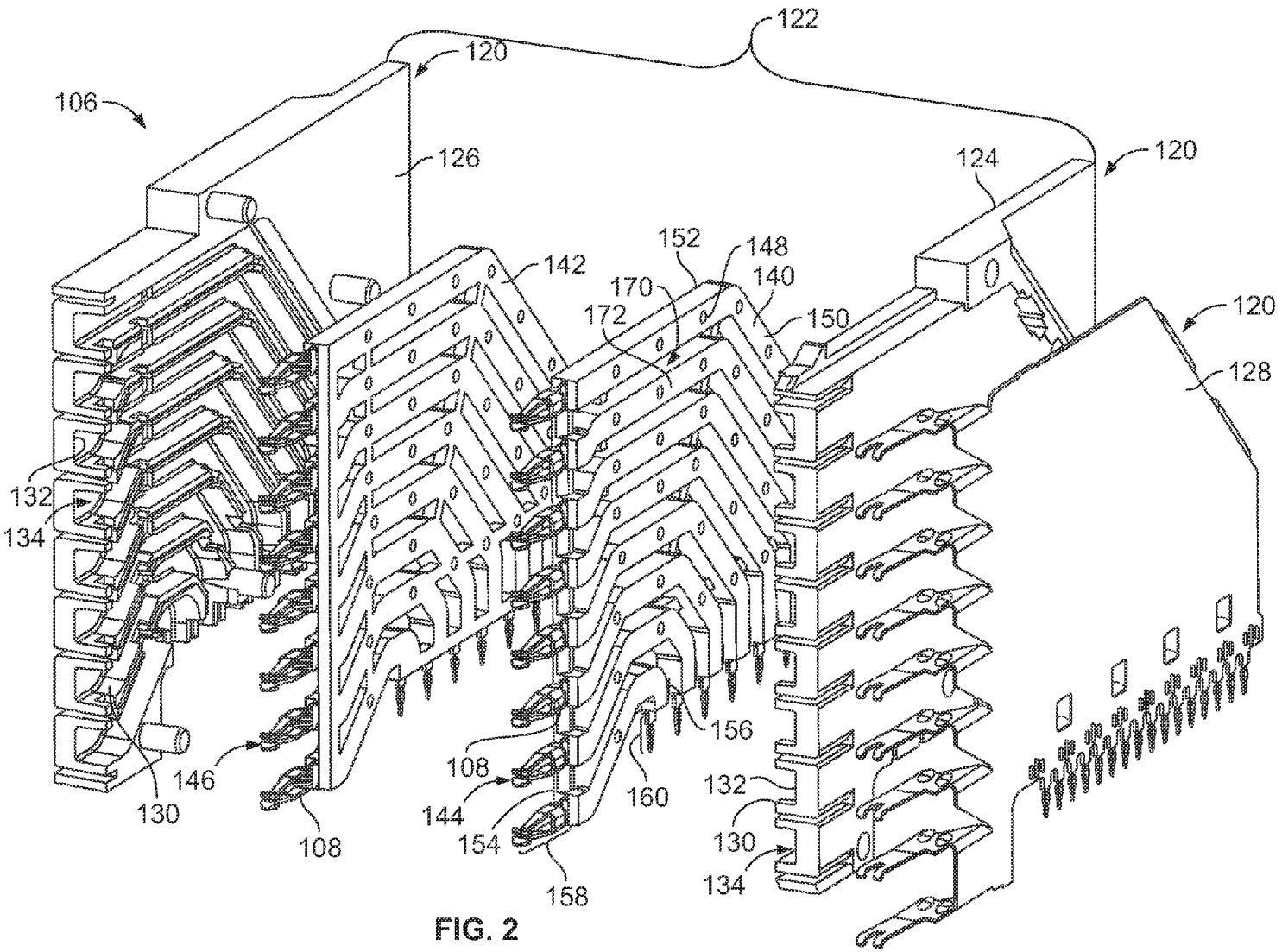
FIG. 2 is an exploded view of a contact module of the electrical connector shown in FIG. 1.

FIG. 2 is an exploded view of one of the contact modules 106. The contact module 106 has a shield body 120 for providing electrical shielding for the contacts 108. The shield body 120 provides shielding from electromagnetic interference (EMI) and/or radio-frequency interference (RFI). The shield body 120 may provide shielding from other types of interference as well.

In an exemplary embodiment, the contact module 106 includes a holder 122 made up of a first holder member 124 and a second holder member 126 that are coupled together to form the holder 122. The contact module 106 also includes a ground shield 128 that may be coupled to the first holder member 124 and/or the second holder member 126. The first and second holder members 124, 126, as well as the ground shield 128, form the shield body 120. The first and second holder members 124, 126 and the ground shield 128 cooperate to provide electrical shielding around the contacts 108.

The holder members 124, 126 are fabricated from a conductive material. For example, the holder members 124, 126 may be die cast from a metal material. Alternatively, the holder members 124, 126 may be stamped and formed or may be fabricated from a plastic material that has been metalized or coated with a metallic layer. By having the holder members 124, 126 fabricated from a conductive material, the holder members 124, 126 provide electrical shielding for the contact modules 106. The holder members 124, 126 include tabs 130 extending inward from side walls 132 thereof. The tabs 130 define channels 134 therebetween.

The ground shield 128 is configured to be coupled the first holder member 124 and may be electrically connected to the circuit board 102 (shown in FIG. 1) to electrically common the shield body 120 to a ground plane of the circuit board 102. The ground shield 128 engages the holder 122 to electrically common the holder 122 with the ground plane of the circuit board 102. Other means may be used in alternative embodiments to electrically common the holder 122 with the ground plane of the circuit board 102, such as by using a conductive gasket between the holder 122 and the circuit board 102. Alternatively, the holder 122 may include features, such as conductive pins, that extend into the circuit board 102 to electrically common the holder 122 with the circuit board 102. In other alternative embodiments, rather than having the holder 122 being conductive and part of the shield body 120, the holder 122 may be manufactured from a dielectric material, and the ground shield 128 may provide all the shielding for the contact module 106.

The contact module 106 includes a pair of dielectric frames 140, 142 surrounding the contacts 108. In an exemplary embodiment, some of the contacts 108 are initially held together as a lead frame 144 (shown in more detail in FIG. 3), which is overmolded with a dielectric material to form the dielectric frame 140. Other contacts 108 are initially held together as a lead frame 146, which may be substantially similar to the lead frame 144. The lead frame 146 is overmolded with a dielectric material to form the dielectric frame 142. The dielectric frames 140, 142 are held in the holder members 124, 126, respectively. The holder members 124, 126 provide shielding around the dielectric frame 140 and the contacts 108 encased by the dielectric frame 140.

During the overmolding process, the lead frame 144 is held by a support structure, which includes pinch pins that engage the lead frame 144 to hold the lead frame 144 at pinch points. The dielectric frame 140 is overmolded over the lead frame 144. When the support structure is removed from the dielectric frame 140, voids 148 are formed in dielectric frame 140. The voids 148 expose portions of the lead frame 144 while a majority of the lead frame 144 is encased in the dielectric material of the dielectric frame 140. In the illustrated embodiment, the voids 148 are cylindrical in shape and are relatively small compared to the overall size of the dielectric frame 140. Because the voids 148 expose the lead frame 144 to air, it is desirable to make the voids 148 as small as possible. Having the lead frame 144 exposed to air affects the electrical characteristics of signals transmitted by the contacts 108. In an exemplary embodiment, the contacts 108 are designed to compensate for the voids 148 to reduce and/or negate the effect of the voids 148.

The dielectric frame 140 has opposite sides 150, 152, a mating edge 154 and a mounting edge 156. The voids 148 extend inward from the sides 150, 152 to expose the lead frame 144. In an exemplary embodiment, the sides 150, 152 are generally planar and parallel to one another. The mating edge 154 and the mounting edge 156 are generally perpendicular with respect to one another, however, other configurations are possible in alternative embodiments. The mating edge 154 is generally provided at the front of the dielectric frame 140. The mounting edge 156 is generally provided at the bottom of the dielectric frame 140.

The lead frame 144 has mating portions 158 extending from the mating edge 154 and mounting portions 160 extending from the mounting edge 156. The contacts 108 have transition portions 164 (shown in FIG. 3) that extend between the mating and mounting portions 158, 160. The transition portions 164 are encased in the dielectric material of the dielectric frame 140. The mating portions 158 and mounting portions 160 are exposed beyond the mating edge 154 and mounting edge 156, respectively. In the illustrated embodiment, the mating portions 158 include opposing spring beams that define a receptacle for receiving mating contacts of the header connector (not shown). Other types of mating portions may be used in alternative embodiments for mating with a mating connector. The mounting portions 160 constitute compliant pins, such as eye-of-the-needle pins, that are configured to be received in plated vias of the circuit board 102 (shown in FIG. 1). Other types of mounting portions may be used in alternative embodiments for terminating to the circuit board or for terminating to wires or another connector, depending on the particular application.

The dielectric frame 140 includes windows 170 extending through the dielectric frame 140 between individual frame members 172. Each frame member 172 encases a different transition portion 164 of a corresponding contact 108. The frame members 172 are received in corresponding channels 134 in the holder member 124. When the dielectric frame 140 is loaded into the holder member 124 the tabs 130 extend into the windows 170 and provide shielding between the contacts 108. The voids 148 exist in the frame members 172. The side wall 132 of the holder member 124 covers the voids 148. Optionally, the side wall 132 may include protrusions (not shown) extending therefrom that extends at least partially into the voids 148. The protrusions may thus be positioned closer to the lead frame 144 than the side walls 132. The protrusions position the shield body 120 closer to the lead frame 144 in the area of the voids 148, which may affect the electrical characteristics of the contacts 108. The dielectric frame 142 is similarly loaded into the holder member 126 such that the side wall 132 of the holder member 126 covers the voids 148 in the dielectric frame 142.

In an exemplary embodiment, the dielectric frames 140, 142 may be arranged within the holder members 124, 126 such that the contacts 108 are arranged as differential pairs. Each differential pair defines a transmission unit. One contact of each differential pair may be part of the dielectric frame 140 and held in the first holder member 124, while the other contact 108 of the differential pair may be part of the dielectric frame 142 and held in the second holder member 126. The contacts 108 of the differential pair are aligned with one another and follow a common path such that the contacts 108 of the differential pair have equal lengths between the mating portions 158 and mounting portions 160. As such, the contacts 108 are skewless.

The tabs 130 define portions of the shield body 120 that are disposed between adjacent differential pairs. The holder 122 provides 360° shielding around each differential pair of contacts 108, with the side walls 132 and tabs 130 providing the shielding around the differential pair of contacts 108.

Figure 3:
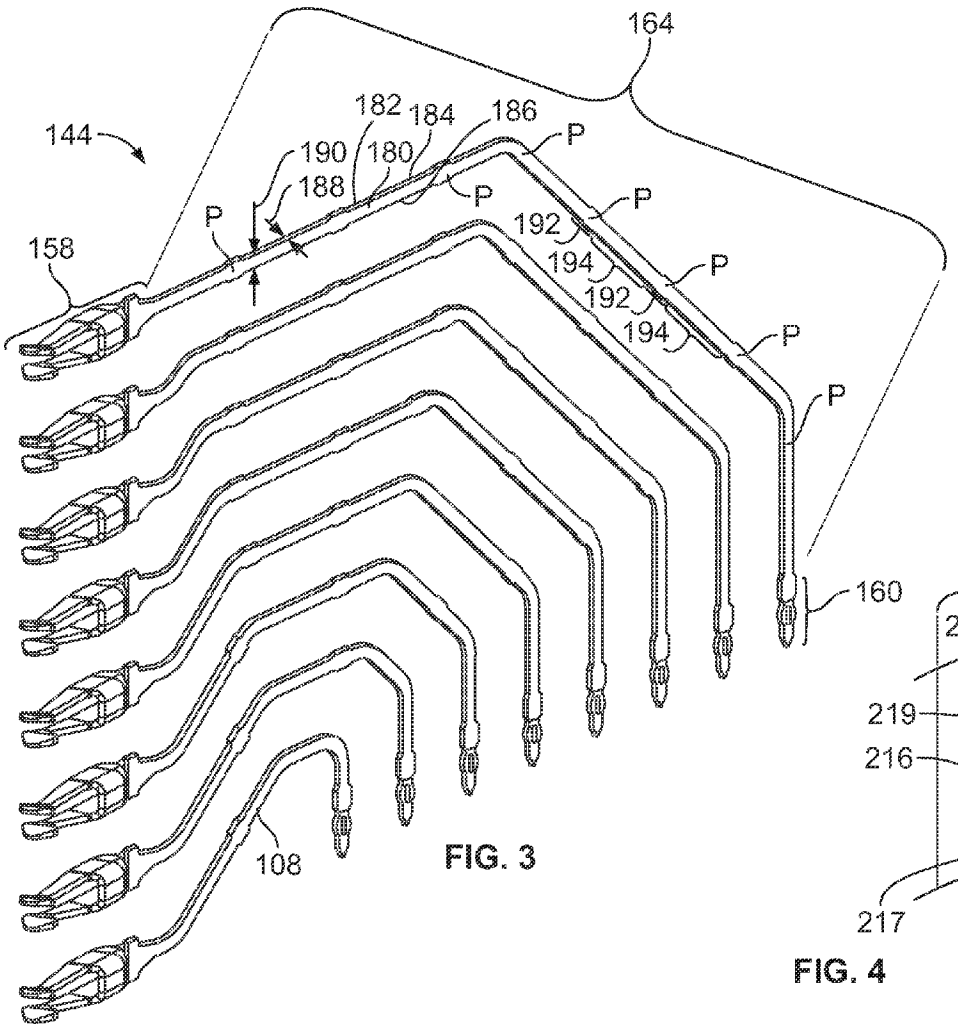
FIG. 3 is a side view of a lead frame of the contact module shown in FIG. 2.

FIG. 3 is a side view of the lead frame 144. The lead frame 146 (within the other frame body 142 shown in FIG. 2) may be similar to the lead frame 144. The lead frame 144 includes a plurality of the contacts 108, which are initially held together by a carrier as a single unit for overmolding the dielectric frames. Portions of the carrier of the lead frame 144 are removed prior to, during, or after overmolding to electrically separate the individual contacts 108.

The contacts 108 have the transition portions 164 extending between the mating portions 158 and the mounting portions 160. The transition portions 164 are the portions of the contacts 108 that are encased in the dielectric material of the dielectric frame 140. In an exemplary embodiment, the lead frame 144 is stamped and formed.

The transition portions 164 have opposite broad sides 180, 182 and opposite edge sides 184, 186. The edge sides 184, 186 are defined by the cut during the stamping process. Edge sides 184, 186 of adjacent contacts 108 oppose one another. The transition portions 164 have a thickness 188 defined between the broad sides 180, 182. The transition portions 164 have a width 190 defined between the edge sides 184, 186. During manufacture, the lead frame 144 is held by the pinch pins of the support structure at pinch points P, which engage the broad sides 180, 182. The dielectric frame 140 (shown in FIG. 2) is then overmolded with dielectric material over the lead frame 144, encasing the lead frame 144 in the dielectric material. When the pinch pins are removed, the voids 148 (shown in FIG. 2) are left behind exposing the broad sides 180, 182 of the lead frame 144 at the pinch points P.

In an exemplary embodiment, the transition portions 164 have compensation segments 192 and intermediate segments 194 between the compensation segments 192. The compensation segments 192 are provided at the pinch points P. The intermediate segments 194 are encased in the dielectric frame 142, while the compensation segments 192 are exposed by the voids 148. The compensation segments 192 have a geometry that differs from a geometry of the intermediate segments 194.

The geometry of each compensation segment 192, as compared to the intermediate segment(s) 194, is selected to achieve similar electrical properties to that of the adjacent intermediate segment(s) 194. In use, signals are transmitted by the contacts 108 between the mating portions 158 and the mounting portions 160. The contacts 108 are designed to have certain electrical characteristics. The dielectric around the contacts 108 affects the electrical characteristics of the signals. For example, the impedance of the contact 108 may be higher at the voids 148 and lower along the dielectric bodies of the dielectric frame 140. The voids 148 may increase an impedance of the contact 108 at the pinch point P. For example, the contact 108 may have a target impedance of 50 Ohms. The voids 148 may increase the impedance to above 50 Ohms. Moreover, the voids 148 may change an electromagnetic field structure between the contacts 108 and the shield body 120 (shown in FIG. 2). Accordingly, a speed of the signals through the contacts 108 may be reduced.

The compensation segments 192 compensate for the voids 148. The compensation segments 192 reduce the impedance of the contacts 108 along the transmission path through the compensation segments 192. For example, the compensation segments 192 may reduce the impedance to a desired impedance, such as 50 Ohms. The compensation segments 192 may improve the field structure of the signals between the contacts 108 and the shield body 120 so that speeds of the signals through the contacts 108 are increased.

In the illustrated embodiment, the compensation segments 192 are wider than the intermediate segments 194. For example, a distance between the edge sides 184, 186 of each of the compensation segments 192 is greater than a distance between the edge sides 184, 186 of each of the intermediate segments 194. In alternative embodiments, the compensation segments 192 may be thicker (shown in FIG. 4) than the intermediate segments 194. For example, the distances between the broad sides 180, 182 of each of the compensation segments 192 may be greater than the distances between the broad sides 180, 182 of each of the intermediate segments 194.

Figure 4:
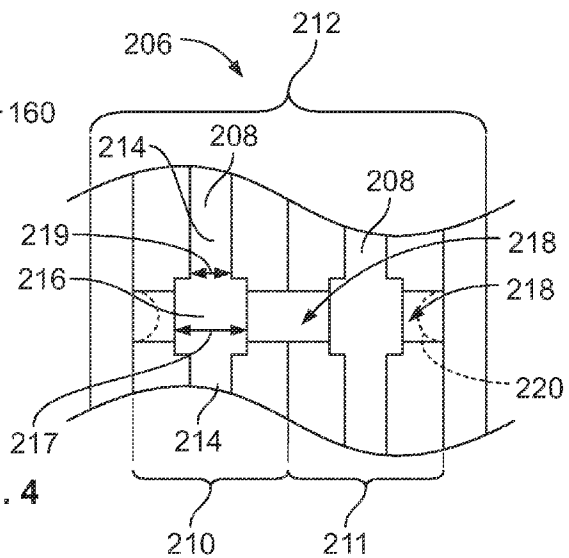
FIG. 4 is a sectional view of a portion of an alternative contact module for the electrical connector shown in FIG. 1.

FIG. 4 is a sectional view of a portion of a contact module 206 showing a pair of contacts 208 arranged side-by-side. The contacts 208 are encased in dielectric members 210, 211 and held in a holder 212 of the contact module 206. The holder 212 defines a shield body surrounding the pair of contacts 208. The contacts 208 have intermediate segments 214 and compensation segments 216. The compensation segments 216 have thicknesses 217 that are greater than thicknesses 219 of the intermediate segments 214. The compensation segments 216 have increased thicknesses that extend toward one another and also toward the shield body of the holder 212. Alternatively, each of the compensation segments 216 may have an increased thickness that extends only toward the other compensation segment or only toward the shield body of the holder 212.

Voids 218 are aligned with the compensation segments 216. Optionally, the shield body may be positioned closer to the compensation segments 216 than the intermediate segments. For example, protrusions 220 (shown in phantom), which are optional elements for the shield body, may extend at least partially into the voids 218 toward the compensation segments 216.

Returning to FIG. 3, in an exemplary embodiment, the compensation segments 192 may have a geometry that positions the compensation segments 192 in closer proximity to one another than a distance between the intermediate segments 194. For example, the compensation segments 192 of adjacent contacts 108 may be positioned closer to one another than the intermediate segments 194 of such contacts 108. The edge side 184 of the compensation segment 192 of one contact 108 is positioned closer to the edge side 186 of the compensation segment 192 of an adjacent contact 108 than the distance between the edge sides 184, 186 of the intermediate segments 194. In other embodiments, the broad side 182 at the compensation segment 192 of one contact 108 is positioned closer to a broad side (not shown) of a compensation segment of a contact 108 of the lead frame 146 (shown in FIG. 2) than the broad side 182 at the intermediate segment 194.

Optionally, the compensation segments 192 have a geometry that positions the compensation segments 192 in closer proximity to the shield body 120 than a distance between the intermediate segments 194 and the shield body 120. For example, when the transition portions 164 are wider or thicker in the compensation segments 192, the transition portions 164 are positioned closer to the tabs 130 or the side wall 132, respectively, than the intermediate segments 194. By positioning the compensation segments 192 closer to the shield body 120, the impedance in the vicinity of the compensation segment 192 may be reduced.

In some embodiments, the shield body 120 may have a geometry that positions the shield body 120 in closer proximity to the compensation segments 192 than to the intermediate segments 194. For example, the shield body 120 may have protrusions or fingers that extend towards the contacts 108 in the areas of the compensation segments 192. For example, the shield body 120 may extend at least partially into the voids 148 such that the shield body 120 is in closer proximity to the compensation segments 192 than the intermediate segments 194. By way of another example, the tabs 130 may have protrusions that extend toward the compensation segment 192.

The amount of compensation may be controlled by controlling the additional width or thickness of the contacts 108 in the compensation segments 192. The amount of compensation may be controlled by controlling the distance between the contacts 108 and the shield body 120 in the areas of the compensation segments 192 as compared to the distance between the contacts 108 and the shield body 120 in the areas of the intermediate segments 194. The geometry of the compensation segments 192 and/or shield body 120 is selected to achieve similar electrical properties to that of the intermediate segments 194. For example, the design may achieve a substantially constant impedance along the entire paths of the contacts 108 between the mating and mounting portions 158, 160, along both the intermediate segments 194 and the compensation segments 192.

Figure 5:
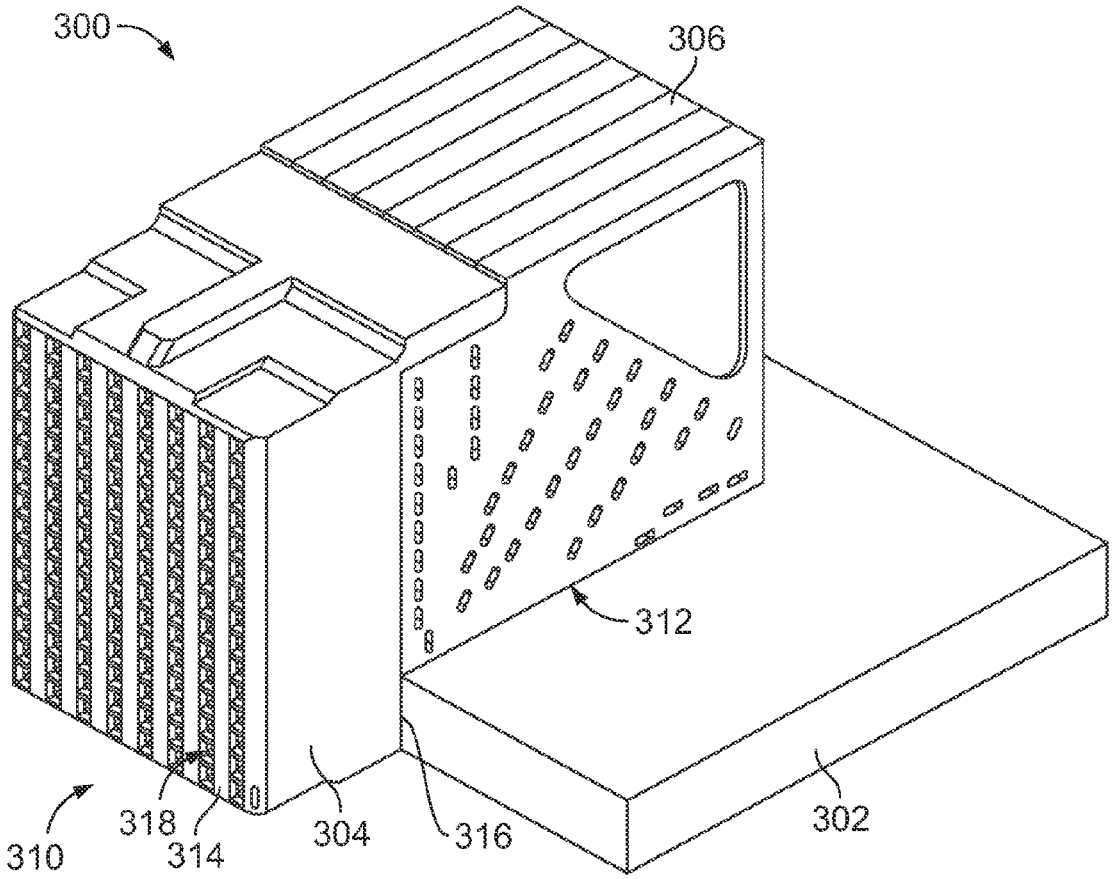
FIG. 5 is a front perspective view of an alternative electrical connector formed in accordance with an exemplary embodiment.

FIG. 5 is a front perspective view of an alternative electrical connector 300 formed in accordance with an exemplary embodiment. The electrical connector 300 is mounted to a circuit board 302. The electrical connector 300 represents a receptacle connector that is configured to be mated with a header connector (not shown) mounted to another circuit board (not shown).

The electrical connector 300 includes a front housing 304 and a plurality of contact modules 306 received within the front housing 304. The contact modules 306 hold a plurality of signal contacts 308 (shown in FIG. 6) that are configured to be mated to the header connector and terminated to the circuit board 302. The electrical connector 300 has a mating interface 310 that is configured to be mated with the header connector. The electrical connector 300 has a mounting interface 312 that is terminated to the circuit board 302. Optionally, the mating and mounting interfaces 310, 312 may be perpendicular to one another.

The front housing 304 includes a front 314 and a rear 316. The front housing 304 has a plurality of contact channels 318 extending therethrough between the front 314 and the rear 316. The contact modules 306 are loaded into the front housing 304 through the rear 316. The front 314 defines the mating interface 310 of the electrical connector 300.

Figure 6:
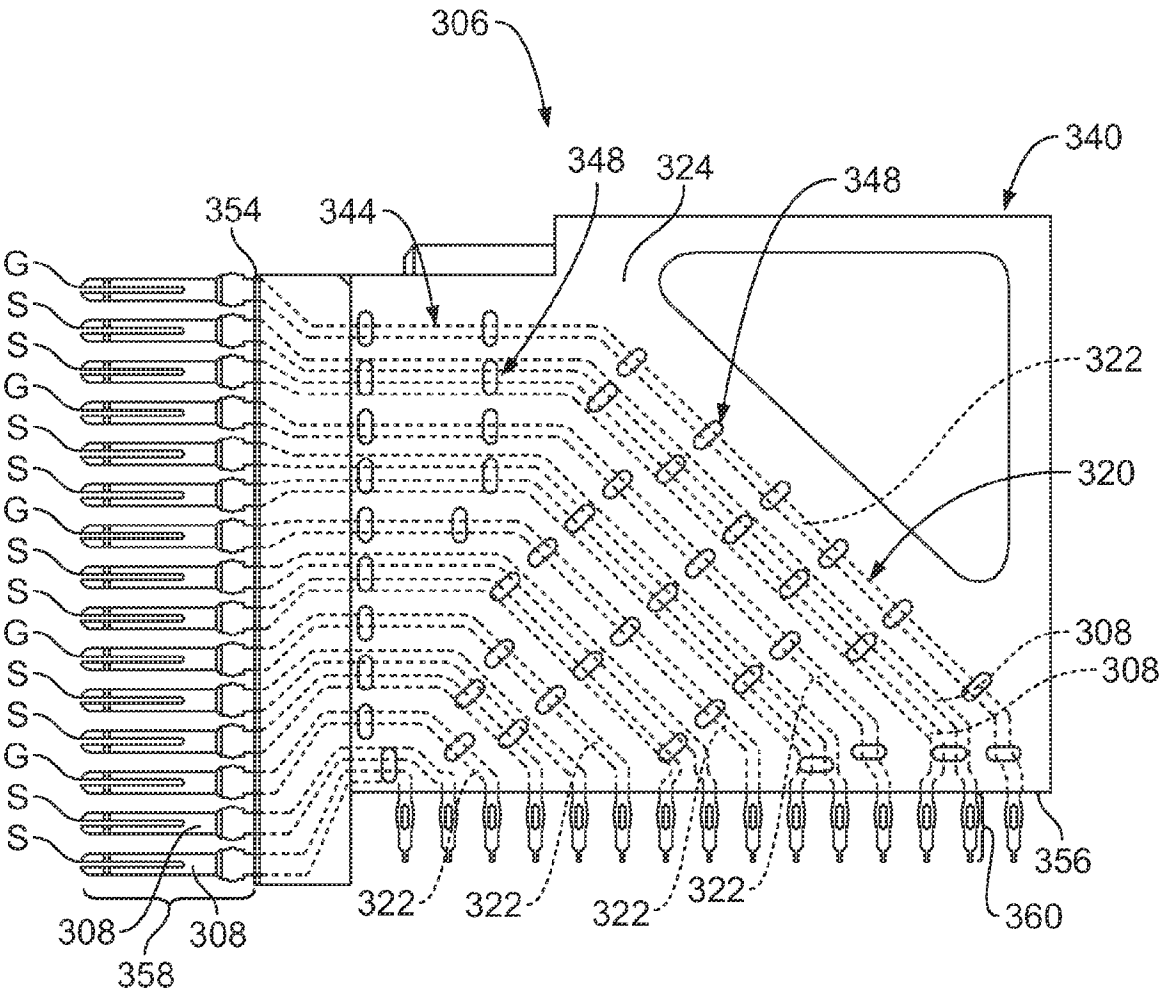
FIG. 6 is a side view of a contact module of the electrical connector shown in FIG. 5.

FIG. 6 is a side view of one of the contact modules 306. The contact module 306 has a shield body 320 defined by ground contacts 322 disposed between the signal contacts 308. The shield body 320 provides electrical shielding for the contacts 308. Optionally, the shield body 320 may include a ground shield mounted to a side 324 of the contact module 306 that provides further shielding for the signal contacts 308. The shield body 320 provides shielding from electromagnetic interference (EMI) and/or radio-frequency interference (RFI). The shield body 320 may provide shielding from other types of interference as well.

The contact module 306 includes a dielectric frame 340 surrounding the signal contacts 308 and ground contacts 322. In an exemplary embodiment, the signal contacts 308 and ground contacts 322 are initially held together as a lead frame 344 (shown in more detail in FIG. 7), which is overmolded with a dielectric material to form the dielectric frame 340.

During the overmolding process, the lead frame 344 is held by a support structure, which includes pinch pins that engage the lead frame 344 to hold the lead frame 344 at pinch points. The dielectric frame 340 is overmolded over the lead frame 344. When the support structure is removed from the dielectric frame 340, voids 348 are formed in dielectric frame 340. The voids 348 expose portions of the lead frame 344 while a majority of the lead frame 344 is encased in the dielectric material of the dielectric frame 340. In the illustrated embodiment, the voids 348 are elliptical in shape and are relatively small compared to the overall size of the dielectric frame 340. Other shaped voids 348 are possible in alternative embodiments. Because the voids 348 expose the lead frame 344 to air, it is desirable to make the voids 348 as small as possible. Having the lead frame 344 exposed to air affects the electrical characteristics of signals transmitted by the contacts 308. In an exemplary embodiment, the contacts 308 are designed to compensate for the voids 348 to reduce and/or negate the effect of the voids 348.

The dielectric frame 340 has a mating edge 354 and a mounting edge 356. The mating edge 354 and the mounting edge 356 are generally perpendicular with respect to one another, however, other configurations are possible in alternative embodiments. The lead frame 344 has mating portions 358 extending from the mating edge 354 and mounting portions 360 extending from the mounting edge 356. The mating portions 358 and mounting portions 360 are exposed beyond the mating edge 354 and mounting edge 356, respectively.

The contacts 308 have transition portions 364 (shown in FIG. 7) that extend between the mating and mounting portions 358, 360. The transition portions 364 are encased in the dielectric material of the dielectric frame 340.

Figure 7:
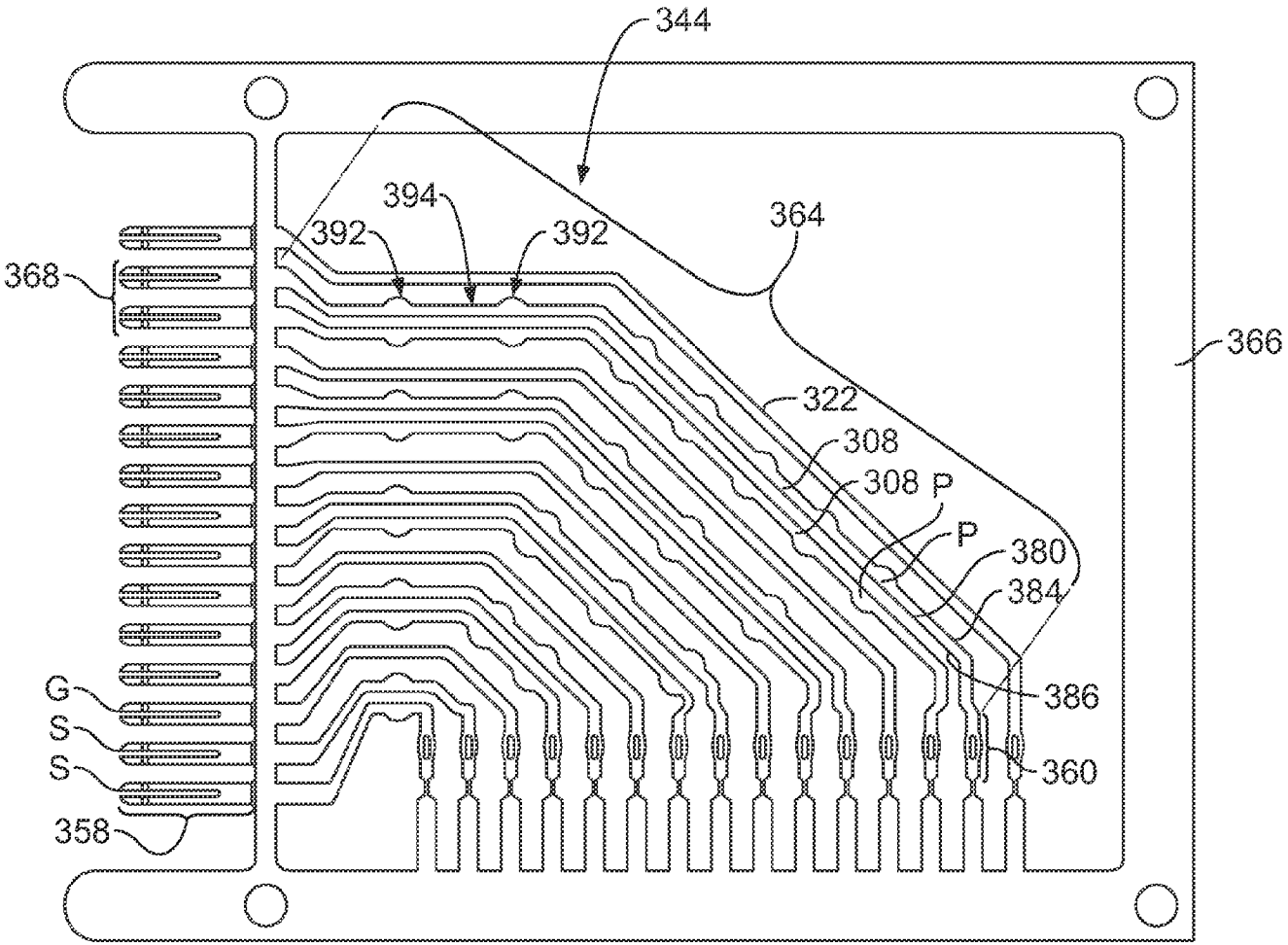
FIG. 7 is a side view of a lead frame of the contact module shown in FIG. 6.

FIG. 7 is a side view of the lead frame 344. The lead frame 344 includes a plurality of the signal contacts 308 and ground contacts 322, which are initially held together by a carrier 366 as a single unit for overmolding the dielectric frames. Portions of the carrier 366 are removed after overmolding to electrically separate the individual contacts 308.

In an exemplary embodiment, the signal contacts 308 are arranged as differential pairs 368 with individual ones of the ground contacts 322 arranged consecutively between the differential pairs 368. The contacts are thus arranged in a ground-signal-signal or signal-signal-ground pattern. The ground-signal-signal or signal-signal-ground contacts define a transmission unit.

The signal contacts 308 have the transition portions 364 extending between the mating portions 358 and the mounting portions 360. The transition portions 364 are the portions of the signal contacts 308 that are encased in the dielectric material of the dielectric frame 340. In an exemplary embodiment, the lead frame 344 is stamped and formed.

The transition portions 364 have opposite broad sides 380 (only one of which is shown in FIG. 7, the other being on the opposite side) and opposite edge sides 384, 386. The edge sides 384, 386 are defined by the cut during the stamping process. Edge sides 384, 386 of adjacent signal contacts 308 oppose one another. The transition portions 364 have a thickness defined between the broad side 380 and the other broad side. The transition portions 364 have a width defined between the edge sides 384, 386. During manufacture, the lead frame 344 is held by the pinch pins of the support structure at pinch points P, which engage the broad side 380 and/or the other broad side. The dielectric frame 340 (shown in FIG. 2) is then overmolded with dielectric material over the lead frame 344, encasing the lead frame 344 in the dielectric material. When the pinch pins are removed, the voids 348 (shown in FIG. 6) are left behind exposing the broad side 380 and/or the other broad side of the lead frame 344 at the pinch points P.

In an exemplary embodiment, the transition portions 364 have compensation segments 392 and intermediate segments 394 between the compensation segments 392. The compensation segments 392 are provided at the pinch points P. The intermediate segments 394 are encased in the dielectric frame 340, while the compensation segments 392 are exposed by the voids 348. The compensation segments 392 have a geometry that differs from a geometry of the intermediate segments 394.

The geometry of each compensation segment 392, as compared to the intermediate segment(s) 394, is selected to achieve similar electrical properties to that of the adjacent intermediate segment(s) 394. In use, signals are transmitted by the signal contacts 308 between the mating portions 358 and the mounting portions 360. The signal contacts 308 are designed to have certain electrical characteristics. The dielectric around the signal contacts 308 affects the electrical characteristics of the signals. For example, the impedance of the signal contact 308 may be higher at the voids 348 and lower along the dielectric bodies of the dielectric frame 340. The voids 348 may increase an impedance of the signal contact 308 at the pinch point P. Moreover, the voids 348 may change an electromagnetic field structure between the signal contacts 308 and the shield body defined by the ground contacts 322. Accordingly, a speed of the signals through the signal contacts 308 may be reduced.

The compensation segments 392 compensate for the voids 348. The compensation segments 392 reduce the impedance of the signal contacts 308 along the transmission path through the compensation segments 392. For example, the compensation segments 392 may reduce the impedance to a desired impedance, such as 50 Ohms. The compensation segments 392 may improve the field structure of the signals between the signal contacts 308 and the ground contacts 322 so that speeds of the signals through the signal contacts 308 are increased.

In the illustrated embodiment, the compensation segments 392 are wider than the intermediate segments 394. In the illustrated embodiment, the compensation segments 392 are wider in one direction, namely the direction toward the nearest ground contact 322. Alternatively, the compensation segments 392 may be wider in both directions or in the direction toward the adjacent compensation segment 392. In alternative embodiments, the compensation segments 392 may be thicker than the intermediate segments 394.

In an exemplary embodiment, the compensation segments 392 may have a geometry that positions the compensation segments 392 in closer proximity to one another than a distance between the intermediate segments 394. The compensation segments 392 may have a geometry that positions the compensation segments 392 in closer proximity to the ground contacts 322 than a distance between the intermediate segments 394 and the ground contacts 322.

In some embodiments, the ground contacts 322 may have a geometry that positions the ground contacts 322 in closer proximity to the compensation segments 392 than to the intermediate segments 394. For example, the ground contacts 322 may have protrusions or flanges that extend towards the signal contacts 308 in the areas of the compensation segments 392.

The amount of compensation may be controlled by controlling the additional width or thickness of the signal contacts 308 in the compensation segments 392. The amount of compensation may be controlled by controlling the distance between the signal contacts 308 and the ground contacts 322 in the areas of the compensation segments 392 as compared to the distance between the signal contacts 308 and the shield body 320 in the areas of the intermediate segments 394. The geometry of the compensation segments 392 and/or the ground contacts 322 is selected to achieve similar electrical properties to that of the intermediate segments 394. For example, the design may achieve a substantially constant impedance along the entire paths of the signal contacts 308 between the mating and mounting portions 358, 360, along both the intermediate segments 394 and the compensation segments 392.

It is to be understood that the above description is intended to be illustrative, and not restrictive. For example, the above-described embodiments (and/or aspects thereof) may be used in combination with each other. In addition, many modifications may be made to adapt a particular situation or material to the teachings of the various embodiments of the invention without departing from their scope. While the dimensions and types of materials described herein are intended to define the parameters of the various embodiments of the invention, the embodiments are by no means limiting and are exemplary embodiments. Many other embodiments will be apparent to those of skill in the art upon reviewing the above description. The scope of the various embodiments of the invention should, therefore, be determined with reference to the appended claims, along with the full scope of equivalents to which such claims are entitled. In the appended claims, the terms "including" and "in which" are used as the plain-English equivalents of the respective terms "comprising" and "wherein." Moreover, in the following claims, the terms "first," "second," and "third," etc. are used merely as labels, and are not intended to impose numerical requirements on their objects. Further, the limitations of the following claims are not written in means-plus-function format and are not intended to be interpreted based on 35 U.S.C. §112, sixth paragraph, unless and until such claim limitations expressly use the phrase "means for" followed by a statement of function void of further structure.

This written description uses examples to disclose the various embodiments of the invention, including the best mode, and also to enable any person skilled in the art to practice the various embodiments of the invention, including making and using any devices or systems and performing any incorporated methods. The patentable scope of the various embodiments of the invention is defined by the claims, and may include other examples that occur to those skilled in the art. Such other examples are intended to be within the scope of the claims if the examples have structural elements that do not differ from the literal language of the claims, or if the examples include equivalent structural elements with insubstantial differences from the literal languages of the claims.

What is claimed is:

1. An electrical connector comprising:

a contact module having a lead frame and a dielectric frame encasing the lead frame;

the dielectric frame comprising opposite sides, a mating edge and a mounting edge, the dielectric frame having voids extending from the sides to expose the lead frame; and the lead frame comprising a plurality of contacts having transition portions extending between mating portions extending from the mating edge and mounting portions extending from the mounting edge, the transition portions having compensation segments and intermediate segments between the compensation segments, the intermediate segments being encased in the dielectric frame, the compensation segments being exposed by the voids, the compensation segments having a geometry that differs from a geometry of the intermediate segments, wherein the intermediate segments are longer than the compensation segments such that a majority of the transition portions are encased by the dielectric frame.

2. The electrical connector of claim 1, wherein the compensation segments are at least one of wider or thicker than the intermediate segments.

3. The electrical connector of claim 1, wherein the geometry of the compensation segments is selected to achieve similar electrical properties to that of the intermediate segments.

4. The electrical connector of claim 1, wherein the contacts are arranged as differential pairs, the compensation segments of the contacts within a differential pair have a geometry that positions the compensation segments in closer proximity to one another than a distance between the intermediate segments of the contacts within the differential pair.

5. The electrical connector of claim 1, wherein the contacts are arranged as a transmission unit including two contacts defining signal contacts comprising a differential pair and at least one ground contact, the compensation segments having a geometry that positions at least one of the signal contacts of the transmission unit in closer proximity to the ground contact of the transmission unit than a distance between the ground contact and the corresponding intermediate segments of the signal contacts of the transmission unit.

6. The electrical connector of claim 1, wherein the contact module comprises a ground shield coupled to one side of the dielectric frame, the compensation segments have a geometry that positions the compensation segments in closer proximity to the ground shield than a distance between the corresponding intermediate segments and the ground shield.

7. The electrical connector of claim 1, wherein the contact module comprises a ground shield coupled to one side of the dielectric frame, the ground shield covering the voids, the ground shield being positioned in closer proximity to the compensation segments than to the intermediate segments.

8. The electrical connector of claim 1, wherein the transition portions have opposite broad sides and opposite edge sides, the transition portions having widths defined between the edge sides and thicknesses defined between the broad sides, the widths of the compensation segments being wider than the widths of the corresponding intermediate segments.

9. The electrical connector of claim 1, wherein the transition portions have opposite broad sides and opposite edge sides, the transition portions having widths defined between the edge sides and thicknesses defined between the broad sides, the thicknesses of the compensation segments being thicker than the thicknesses of corresponding intermediate segments.

10. The electrical connector of claim 1, wherein the transition portions have opposite broad sides and opposite edge sides, the geometry of the compensation segments being such that at least one of the broad sides or edge sides project outward from the corresponding broad sides or edge sides of the adjacent intermediate segments.

11. An electrical connector comprising:

a contact module having a holder that holds a pair of dielectric frames, each dielectric frame encasing a corresponding lead frame, the holder being manufactured from a conductive material and defining a shield body providing electrical shielding around the corresponding pair of dielectric frames;

each dielectric frame comprising opposite sides, a mating edge and a mounting edge, each dielectric frame having voids extending from the sides to expose the corresponding lead frame; and each lead frame comprising a plurality of contacts having transition portions extending between mating portions extending from the mating edge and mounting portions extending from the mounting edge, the transition portions having compensation segments and intermediate segments between the compensation segments, the intermediate segments being encased in the corresponding dielectric frame, the compensation segments being exposed by the voids in the corresponding dielectric frame, the compensation segments having a geometry that differs from a geometry of the intermediate segments.

12. The electrical connector of claim 11, wherein the holder of the contact module includes tabs extending into the dielectric frames between adjacent contacts to provide electrical shielding between the adjacent contacts.

13. The electrical connector of claim 11, wherein the compensation segments are at least one of wider or thicker than the intermediate segments.

14. The electrical connector of claim 11, wherein the geometry of the compensation segments is selected to achieve similar electrical properties to that of the intermediate segments.

15. The electrical connector of claim 11, wherein the contacts are arranged as differential pairs with one contact of the differential pair being held in one of the dielectric frames and the other contact of the differential pair being held in the other dielectric frame, the compensation segments of the contacts within a differential pair have a geometry that positions the compensation segments in closer proximity to one another than a distance between the intermediate segments of the contacts within the differential pair.

16. An electrical connector comprising:

a contact module comprising a lead frame and a dielectric frame encasing the lead frame, the contact module further comprising a shield body extending along the dielectric frame;

the dielectric frame comprising opposite sides, a mating edge and a mounting edge, the dielectric frame having voids extending from the sides to expose the lead frame;

the lead frame comprising a plurality of contacts having transition portions extending between mating portions extending from the mating edge and mounting portions extending from the mounting edge, the transition portions having compensation segments and intermediate segments between the compensation segments, the intermediate segments being encased in the dielectric frame, the compensation segments being exposed by the voids; and the shield body extending along at least one of the sides of the dielectric frame, the shield body covering corresponding voids in the at least one of the sides of the dielectric frame, the shield body being positioned in closer proximity to the compensation segments than to the intermediate segments.

17. The electrical connector of claim 16, wherein the compensation segments have a geometry that positions the compensation segments in closer proximity to the shield body than a distance between the shield body and the intermediate segments.

18. The electrical connector of claim 16, wherein the shield body has a first surface extending along the at least one of the sides of the dielectric frame, the shield body includes extensions that extend from the first surface at least partially into corresponding voids, the extensions being positioned in closer proximity to the compensation segments than a distance between the first surface and the intermediate segments.

19. The electrical connector of claim 16, wherein the shield body comprises a conductive holder surrounding the dielectric frame.

20. The electrical connector of claim 16, wherein the shield body comprises a ground shield attached to one of the sides of the dielectric frame.

* * * * *